US008578849B2

(12) United States Patent
Kusaka et al.

(10) Patent No.: US 8,578,849 B2
(45) Date of Patent: Nov. 12, 2013

(54) LIQUID SUPPLY APPARATUS AND METHOD OF MANUFACTURING PLATE THEREFOR

(75) Inventors: Akehiro Kusaka, Noda (JP); Susumu Takezawa, Noda (JP)

(73) Assignee: Komori Corporation, Tokyo (JP)

( * ) Notice: Subject to any disclaimer, the term of this patent is extended or adjusted under 35 U.S.C. 154(b) by 947 days.

(21) Appl. No.: 12/219,326

(22) Filed: Jul. 18, 2008

(65) Prior Publication Data

US 2009/0041931 A1 Feb. 12, 2009

(30) Foreign Application Priority Data

Aug. 6, 2007 (JP) ..... 2007-203795

(51) Int. Cl.
*B41L 13/00* (2006.01)
*B41C 1/14* (2006.01)

(52) U.S. Cl.
USPC ..... 101/119; 101/116; 101/128.4

(58) Field of Classification Search
USPC ..... 101/119, 120, 128.4, 129, 116
See application file for complete search history.

(56) References Cited

U.S. PATENT DOCUMENTS 3,844,213 A * 10/1974 Graybeal ..... 101/129
5,740,733 A * 4/1998 Mungenast ..... 101/128.4
5,960,716 A 10/1999 Schaede
6,155,165 A * 12/2000 Kaule ..... 101/116
7,107,904 B2 9/2006 Kusaka et al.
2004/0237812 A1* 12/2004 Rush ..... 101/118
2007/0193456 A1* 8/2007 Aoki ..... 101/119

FOREIGN PATENT DOCUMENTS

EP 201 16 246 U1 3/2002
EP 1 717 028 A2 11/2006
EP 1 820 646 A2 8/2007
JP 2000-504643 A 4/2000
JP 2005-254640 A 9/2005

* cited by examiner

*Primary Examiner* — Ren Yan
(74) *Attorney, Agent, or Firm* — Birch, Stewart, Kolasch & Birch, LLP

(57) ABSTRACT

A screen printing unit equipped with a rotary screen apparatus comprises a cylindrical screen rotatably supported so as to be brought into contact with a rotatable impression cylinder. Multiple small holes are formed in the circumferential surface of the screen, and are filled up with a coating material. Some of the holes corresponding to a pattern not being filled with the coating material, and a special ink stored inside the screen can be supplied to a sheet held on the outer circumferential surface of the impression cylinder so as to form a shape corresponding to the pattern. The small holes are formed only in an area of the screen in the circumferential direction thereof extending from a position corresponding to the downstream-side end of the sheet in the sheet-conveying direction to a position corresponding to the upstream-side end of the sheet in the sheet-conveying direction.

5 Claims, 11 Drawing Sheets

LIQUID SUPPLY APPARATUS AND METHOD OF MANUFACTURING PLATE THEREFOR

BACKGROUND OF THE INVENTION

1. Field of the Invention

The present invention relates to a liquid supply apparatus that performs printing, coating, or the like by supplying liquid, such as ink or varnish, with a liquid supply member, through holes formed in a plate, such as a screen, to a sheet, such as a paper sheet, held by an impression cylinder and a method of manufacturing a plate therefor. Particularly, the liquid supply apparatus of the present invention is effective when applied to a screen printing unit of a printing press that performs screen printing on a paper sheet.

2. Description of the Related Art

For example, in a conventional procedure of screen printing on a paper sheet, a rotary screen apparatus is employed. The rotary screen apparatus has a cylindrical thin screen in which small holes corresponding to a pattern are formed, and is provided with a squeegee which is a liquid supply member placed inside the screen. Liquid such as ink or varnish, which is stored inside the screen, is squeezed out through the small holes of the screen by the squeegee. In this way, a screen printing corresponding to the pattern is performed on a paper sheet held on an outer circumference of an impression cylinder by using the liquid such as ink or varnish. Since the rotary screen apparatus can perform thickly embossed printing on a paper sheet with a special ink or the like, the rotary screen apparatus is used for the purpose of giving a high-quality looking and touch.

The screen of the rotary screen apparatus is commonly manufactured in the following way. Firstly, multiple small holes are formed in the entire body of a thin cylindrical base material both in the circumferential and the axial directions so that the base material has a mesh structure. Then, a photosensitive material is provided to all of the small holes so that all of the small holes can be filled up with the photosensitive material. The photosensitive material is removed from some of the small holes that are located at positions corresponding to a pattern. The screen thus manufactured is then used in a screen printing process for the pattern, and the photosensitive material is removed from the entire body of the base material after printing. Subsequently, the base material is provided with another photosensitive material with which all the small holes of the base material are filled up. Then, the photosensitive material is removed from some of the small holes that are located at positions corresponding to a different pattern. The screen thus manufactured is then used in a screen printing process for the new pattern.

As described above, the base material for the above-described screen can be used repeatedly. A screen of another type is provided with a base material that is cylindrical in shape and made of a thin plate with no holes formed therein. The screen is manufactured by forming small holes in the base material so that the small holes can be formed at positions corresponding to a pattern. Once the screen printing process is finished for the pattern using the screen, another screen has to be prepared from the beginning (e.g., the preparation for another base material). The screen with the repeatedly usable base material is much less wasteful than the one with the base material that is not repeatedly used. Accordingly, since the screen with the repeatedly usable base material can be used at lower costs, the screen of this type is widely used.

Incidentally, the screen is thin, and thus biased outwards by the squeegee in the radial direction. Suppose a case where the screen faces grippers of the impression cylinder that are provided for holding the paper sheet or a case where the screen faces a gap portion which is formed in the impression cylinder and in which the grippers are installed. In these cases, the contact of the screen with the grippers (projections) or the falling down of the screen into the gap portion may cause damages to the screen. As a result, the screen tends to have a shorter lifetime.

For example, a measure to address this problem is proposed in Japanese Patent Publication No. 2000-504643A and U.S. Pat. No. 5,960,716. In the disclosure, the grippers and gripper pads are provided in a gap portion formed in the impression cylinder to prevent the grippers and the gripper pads from projecting out from the outer peripheral surface of the impression cylinder. Moreover, a cover that can be opened and closed is provided to entirely cover the gap portion. When a paper sheet is held and released, the opening and closing operations of the cover are synchronized with those of the grippers. In this way, while holding and releasing a paper sheet is made possible, the screen is prevented from falling into the gap portion of the impression cylinder and from coming into contact with the grippers (projections). As a result, the screen is protected from damages on the screen, which might otherwise occur.

Another example of such measures is disclosed in Japanese Patent Publication No. 2005-254640A. In the disclosure, the grippers and gripper pads are provided in a gap portion formed in the impression cylinder to prevent the grippers and the gripper pads from projecting out from the outer peripheral surface of the impression cylinder. A partial cover member that covers only a part of the gap portion is provided. Accordingly, when a paper sheet is held and released, the grippers are projected from the outer circumferential surface of the impression cylinder. In this way, while holding and releasing a paper sheet is made possible, the screen is prevented from falling into the gap portion of the impression cylinder and from coming into contact with the grippers (projections). As a result, the screen is protected from damages on the screen, which might otherwise occur.

Such apparatus structures as those described in Japanese Patent Publication No. 2000-504643A, Japanese Patent Publication No. 2005-254640A, and the like, however, have a problem. When the screen transfers from a surface of the paper sheet to a surface of the impression cylinder, the screen is abruptly pulled outwards in a radial direction by a length equivalent to the thickness of the paper sheet by the squeegee. The same place on the screen always receives an impact, and the strength of the screen is more likely to deteriorate. Thus, the service life of the screen may possibly be shortened.

Particularly, the rotary screen apparatus described in Japanese Patent Publication No. 2000-504643A or the like has the following problem. A certain position of the screen is always rubbed against the gap between the cover and the gap portion in the rotational direction of the impression cylinder. The strength of the screen is more likely to be deteriorated further, and eventually, lifetime of the screen is shortened.

Such problem as mentioned above may occur not only in a case where thickly embossed printing is performed on a paper sheet with a special ink, but also, in a similar manner such as a case where liquid is supplied to a sheet held by an impression cylinder, with a liquid supplying member, through holes formed in the plate for the rotary screen apparatus. For example, such a problem may occur in a case of applying varnish to an entire surface of a paper sheet.

SUMMARY OF THE INVENTION

Under the above-mentioned circumstances, an object of the present invention is to provide a liquid supply apparatus in which the damage to the plate when the liquid is supplied is minimized and thus the lifetime of a plate is extended and also provide a method of manufacturing a plate therefor.

To solve the above-described problems, a liquid supply apparatus according to an aspect of the present invention has the following technical features. The liquid supply apparatus comprises a rotary screen apparatus that comprises a cylindrical plate and a liquid supply member. The cylindrical plate is rotatably supported so as to be brought into contact with a rotatable impression cylinder. Multiple holes are formed in the circumferential surface of the plate, and are filled up with a coating material. Some of the holes, which are located at positions corresponding to a pattern not being filled with the coating material, so that a liquid stored inside the plate is supplied to a sheet held on the outer circumferential surface of the impression cylinder. The liquid thus supplied forms a shape corresponding to the pattern. The liquid supply member is placed inside the plate so as to be brought into contact with the inner circumferential surface of the plate. The liquid supply member supplies the liquid stored inside the plate to the outside of the plate through the holes from which the coating material is removed. In the liquid supply apparatus, the holes are formed only in an area of the plate in the circumferential direction of thereof. The area is located between two positions. A first one of the two positions corresponds to a first end of the sheet located on the downstream side in the direction in which the sheet is conveyed, and a second one of the two positions corresponds to a second end of the sheet located on the upstream side in the direction in which the sheet is conveyed.

In addition, a liquid supply apparatus according to another aspect of the present invention has the following additional features. In the above-described liquid supply apparatus, the holes are formed in the plate only in an area, in the axial direction thereof, located between two positions. A first one of the two positions corresponds to a first end of the sheet located on a first side thereof in an orthogonal direction to the direction in which the sheet is conveyed, and a second one of the two positions corresponds to a second end of the sheet located on a second side thereof in an orthogonal direction to the direction in which the sheet is conveyed.

In addition, a liquid supply apparatus according to another aspect the present invention has the following additional features. In the above-described liquid supply apparatus, the holes are formed in the plate at a portion covering the area of the sheet that is conveyed by the impression cylinder, and no holes are formed in the plate at a portion located outside of the area of the sheet that is conveyed by the impression cylinder.

In addition, a liquid supply apparatus according to another aspect the present invention has the following additional features. In the above-described liquid supply apparatus, no holes are formed in a following area of the plate. The area is located at the downstream side, in the direction in which the sheet is conveyed. The first end position of the area corresponds to the first end of the sheet located on the downstream side in the direction in which the sheet is conveyed. The area is located at the upstream side, in the direction in which the sheet is conveyed. The second end position of the area corresponds to the second end of the sheet located on the upstream side in the direction in which the sheet is conveyed.

In addition, a liquid supply apparatus according to another aspect the present invention has the following additional features. In the above-described liquid supply apparatus, the coating material is formed in a following area of the plate. The area is located at the downstream side, in the circumferential direction of the plate, of the position corresponding to the downstream-side end of the sheet in the direction in which the sheet is conveyed, and the area being located at the upstream side, in the circumferential direction of the plate, of the position corresponding to the upstream-side end of the sheet in the direction in which the sheet is conveyed.

In addition, a liquid supply apparatus according to another aspect the present invention has the following additional features. The above-described liquid supply apparatus further comprises a gap portion formed in the outer circumferential surface of the impression cylinder and sheet holding means configured to hold the sheet and being installed in the gap portion. In the liquid supply apparatus, the gap portion of the impression cylinder is brought into contact with the portion of the plate where no holes are formed.

On the other hand, a method of manufacturing a plate for a liquid supply apparatus provided with a rotary screen apparatus according to an aspect of the present invention has the following technical features. The rotary screen apparatus comprises a cylindrical plate and a liquid supply member. The cylindrical plate is rotatably supported so as to be brought into contact with a rotatable impression cylinder. Multiple holes formed in the circumferential surface of the plate are filled up with a coating material. Some of the holes located at positions corresponding to a pattern not being filled with the coating material so that a liquid stored inside the plate is supplied to a sheet held on the outer circumferential surface of the impression cylinder. The liquid thus supplied forms a shape corresponding to the pattern. The liquid supply member is placed inside the plate so as to be brought into contact with the inner circumferential surface of the plate. The liquid supply member supplies the liquid stored inside the plate to the outside of the plate through the holes from which the coating material is removed. The method of manufacturing the plate comprises a step of fabricating a mother material of the plate on a mother die by electroforming the mother die in an electroforming solution. In the electroforming step, the holes are formed in the plate at a portion covering the area of the sheet that is conveyed by the impression cylinder, but no holes are formed in the plate at a portion located outside of the area of the sheet that is conveyed by the impression cylinder.

In addition, a method of manufacturing a plate for a liquid supply apparatus according to another aspect the present invention has the following additional features. In the method of manufacturing a plate for a liquid supply apparatus, the step of fabricating a mother material comprises a step of masking and a step of electroforming. In the masking step, a plurality of dimples formed in the outer circumferential surface of the mother die so as to cover the area of the sheet conveyed by the impression cylinder is filled up with a masking material. In the electroforming step, the mother die with the dimples filled up with the masking material is subjected to electroforming performed in the electroforming solution.

In addition, a method of manufacturing a plate for a liquid supply apparatus according to another aspect the present invention has the following additional features. The method of manufacturing a plate for a liquid supply apparatus further comprises a step of coating and a step of removing. In the coating step, the holes formed in the mother material of the plate are coated with a coating material. In the removing step, the coating material is removed from some of the holes formed in the mother material of the plate. The coating material is removed from the holes that correspond to the pattern.

In addition, a method of manufacturing a plate for a liquid supply apparatus according to another aspect the present invention has the following additional features. In the method of manufacturing a plate for a liquid supply apparatus, the coating step is a step of coating, with the coating material, not only the holes formed in the mother material of the plate but also part of the outer circumferential surface in which no holes are formed.

In addition, a method of manufacturing a plate for a liquid supply apparatus according to another aspect the present invention has the following additional features. In the method of manufacturing a plate for a liquid supply apparatus, the mother material is made of at least one selected from the group consisting nickel, copper, an alloy of cobalt and nickel and mixture thereof.

In addition, a method of manufacturing a plate for a liquid supply apparatus according to another aspect the present invention has the following additional features. In the method of manufacturing a plate for a liquid supply apparatus, the mother die has any one of a cylindrical shape and a columnar shape.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
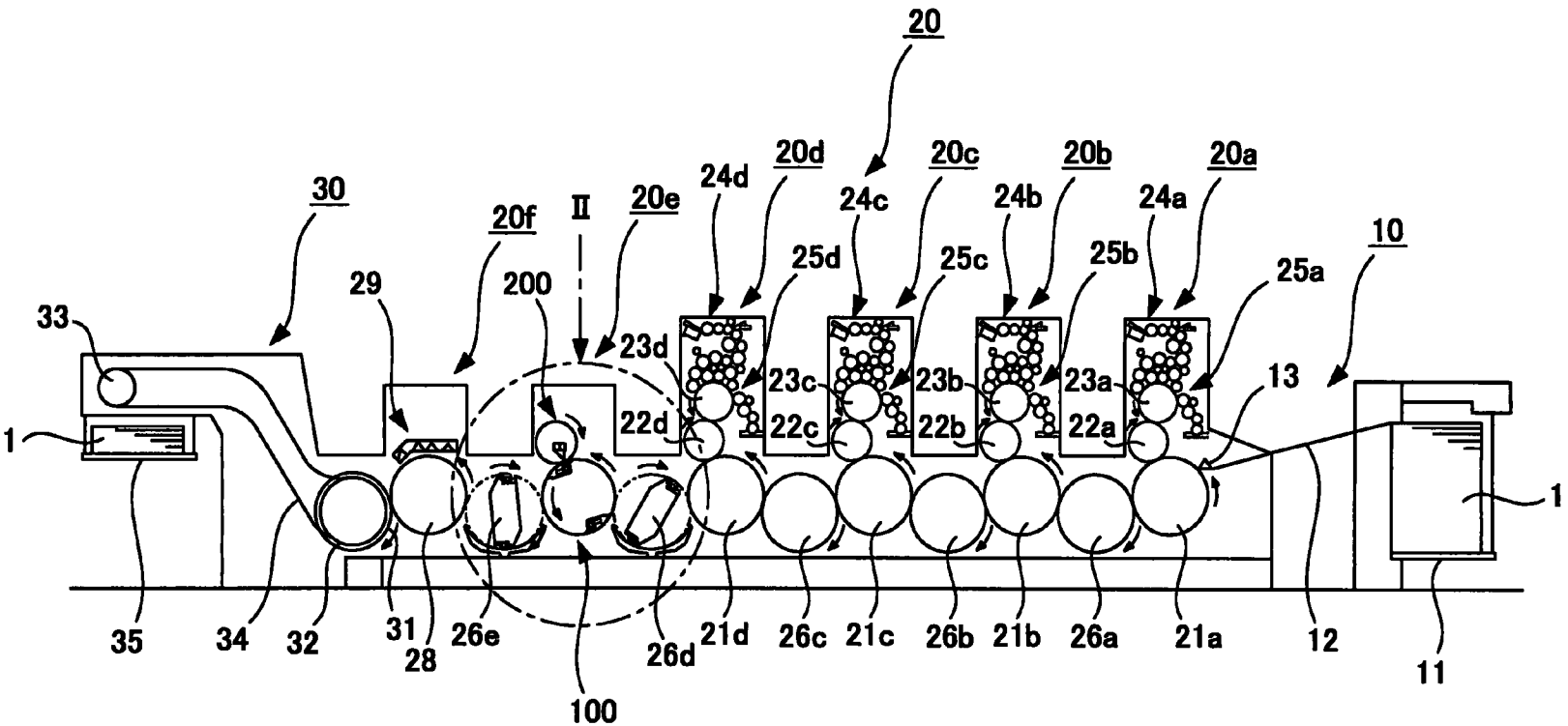
FIG. 1 shows an overall schematic configuration view of a printing press in which a liquid supply apparatus of the present invention is applied to a screen printing unit according to a primary embodiment.

Embodiments of a liquid supply apparatus and a method of manufacturing its plate of the present invention will be explained below by referring to the drawings. Note, however, that the present invention is not limited to the following embodiments.

Main Embodiment

Referring to FIGS. 1 to 9, explanations of a main embodiment of a printing press, in which a liquid supply apparatus and a method of manufacturing its plate according to the present invention is applied to a screen printing unit, will be given.

As shown in FIG. 1, a feeder tray 11 is provided to a feeder 10. A feeder board 12 is provided to a feeder 10, and paper sheets 1 on the feeder tray 11 are fed to a printing unit 20 one by one with the feeder board 12. A swing arm shaft pregripper 13 is provided on a front end of the feeder board 12. The paper sheet 1 is passed to an impression cylinder 21*a* of a first offset printing unit 20*a* of the printing unit 20 with the swing arm shaft pregripper 13.

In the first offset printing unit 20*a* of the printing unit 20, a blanket cylinder 22*a* faces and is brought into contact with the impression cylinder 21*a*, at a position further downstream in the rotational direction of the impression cylinder 21*a* than the swing arm shaft pregripper 13. A plate cylinder 23*a* faces and is brought into contact with the blanket cylinder 22*a*, at a position upper stream in the rotational direction of the blanket cylinder 22*a* than the impression cylinder 21*a*. An ink supplying unit 24*a* is provided at a position upper stream in the rotational direction of the plate cylinder 23*a* than the blanket cylinder 22*a*. A damping unit 25*a* is provided at a position upper stream in the rotational direction of the plate cylinder 23*a* than the ink supplying unit 24*a*.

The impression cylinder 21*a* of the first offset printing unit 20*a* faces and is brought into contact with a transfer cylinder 26*a* at a position further downstream in the rotational direction of the impression cylinder 21*a* than the blanket cylinder 22*a*. An impression cylinder 21*b* of a second offset printing unit 20*b* faces and is brought into contact with the transfer cylinder 26*a*. Thus, the impression cylinders 21*a* and 21*b* face each other, and are, indirectly, brought into contact with each other with the transfer cylinder 26*a* intervening in between. This second offset printing unit 20*b*, as in the case of the first offset printing unit 20*a*, has a blanket cylinder 22*b*, a plate cylinder 23*b*, an ink supplying unit 24*b*, a damping unit 25*b* and the like.

In addition, the impression cylinder 21*b* of the second offset printing unit 20*b* faces and is brought into contact with a transfer cylinder 26*b* at a position further downstream in the rotational direction of the impression cylinder 21*b* than the blanket cylinder 22*b*. An impression cylinder 21*c* of a third offset printing unit 20*c* faces and is brought into contact with the transfer cylinder 26*b*. Thus, the impression cylinders 21*b* and 21*c* face with each other, and are indirectly brought into contact with each other with the transfer cylinder 26*b* intervening in between. As in the case of the first and the second offset printing units 20*a* and 20*b*, this third offset printing unit 20*c* also has a blanket cylinder 22*c*, a plate cylinder 23*c*, an ink supplying unit 24*c*, a damping unit 25*c* and the like.

Moreover, the impression cylinder 21*c* of the third offset printing unit 20*c* faces and is brought into contact with a transfer cylinder 26*c* at a position further downstream in the rotational direction of the impression cylinder 21*c* than the blanket cylinder 22*c*. An impression cylinder 21*d* of a fourth offset printing unit 20*d* faces and is brought into contact with the transfer cylinder 26*c*. Thus, the impression cylinders 21*c* and 21*d* face each other, and are indirectly brought into contact with each other with the transfer cylinder 26*c* intervening in between. This fourth offset printing unit 20*d* also, as in the case of the first to the third offset printing units 20*a* to 20*c*, has a blanket cylinder 22*d*, a plate cylinder 23*d*, an ink supplying unit 24*d*, a damping unit 25*d* and the like.

Figure 2:
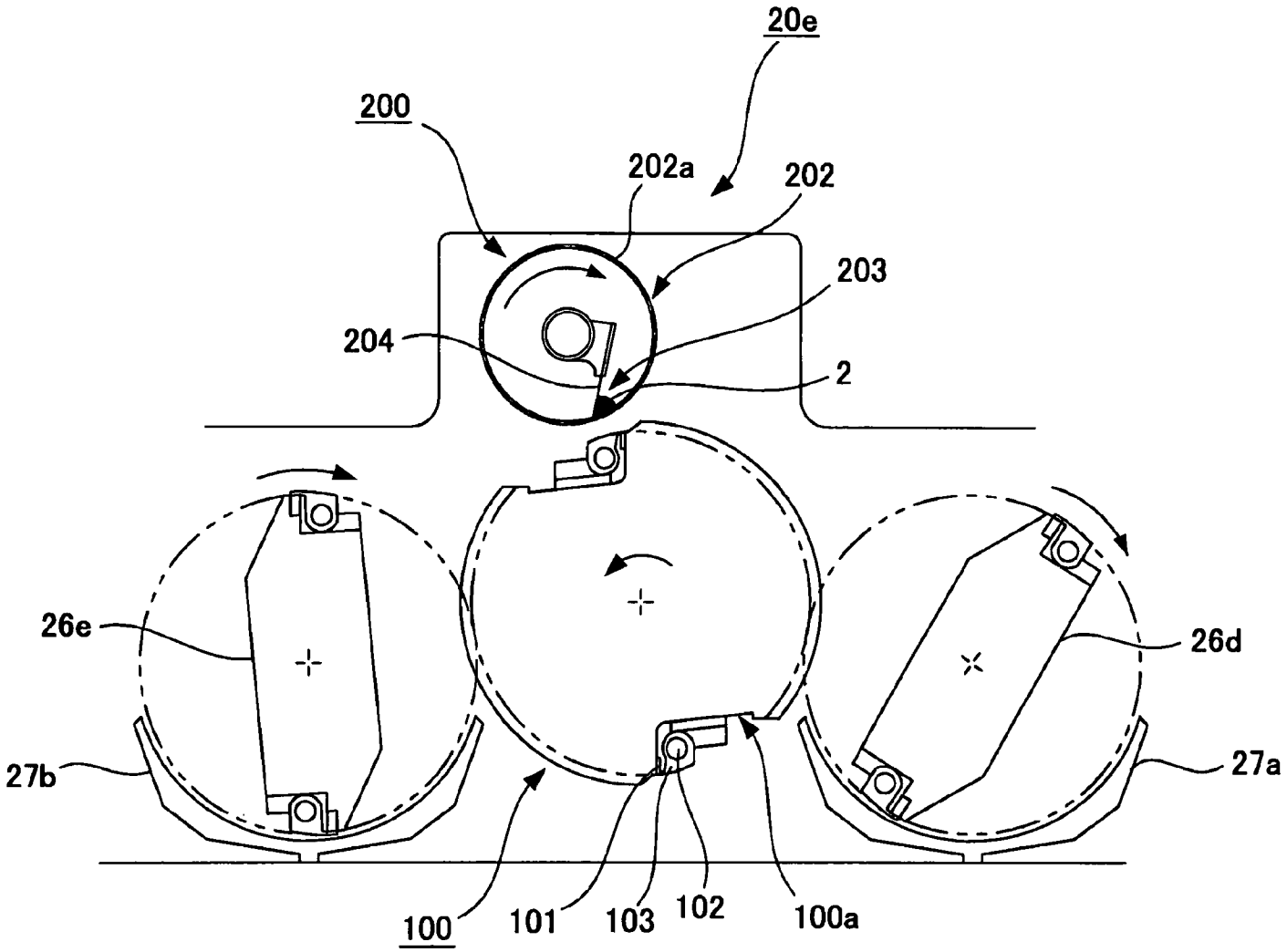
FIG. 2 shows an enlarged view of a part extracted as indicated by an arrow II in FIG. 1.

As shown in FIGS. 1 and 2, the impression cylinder 21*d* of the fourth offset printing unit 20*d* faces and is brought into contact with a transfer cylinder 26*d* at a position further downstream in the rotational direction of the impression cylinder 21*d* than the blanket cylinder 22*d*. An impression cylinder 100 of a screen printing unit 20*e*, which is a liquid supply apparatus, faces and is brought into contact with the transfer cylinder 26*d*. Thus, the impression cylinders 21*d* and 100 face each other, and are indirectly brought into contact with each other with the transfer cylinder 26*d* intervening in between. Note that, as described in Japanese Patent Publication No. 2004-099314A, the transfer cylinder 26*d* is a skeleton cylinder (solid cylinder) and has a guiding unit 27*a* which is provided therebelow, and which blows out air to guide the transfer of the paper sheet 1.

Figure 3:
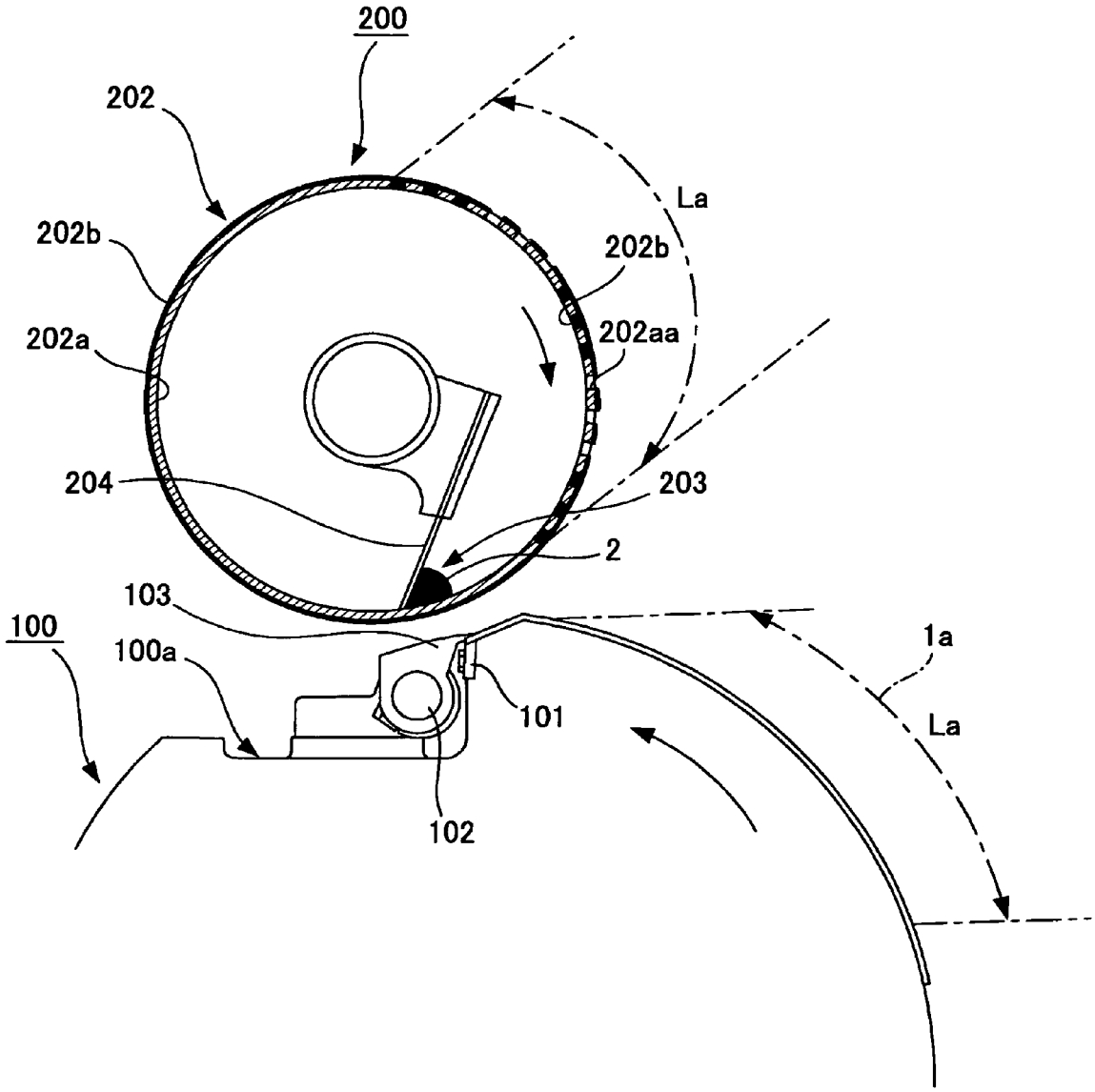
FIG. 3 shows an enlarged view of an extracted main part of FIG. 2.
Figure 4:
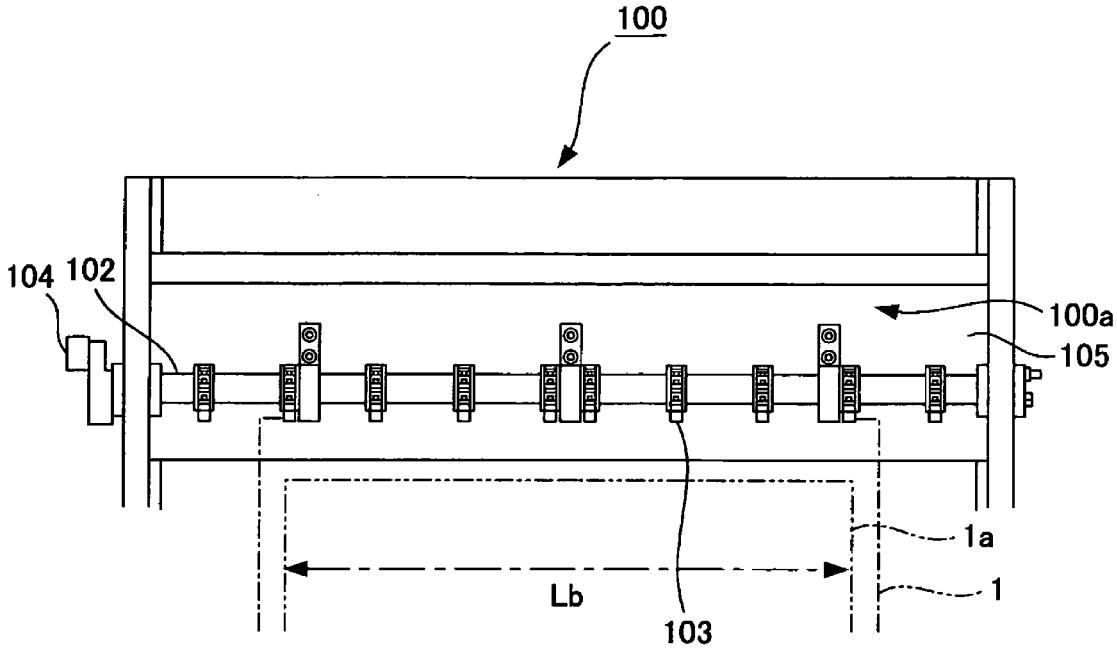
FIG. 4 shows a plan view of an impression cylinder of FIG. 2.

As shown in FIGS. 2 to 4, a plurality of gap portions 100*a* (specifically, two gap portions 100*a*, in this embodiment), each of which is formed along the axial directions of the impression cylinder 100, are formed on the outer peripheral surface of the impression cylinder 100 at even intervals along the circumferential direction of the impression cylinder 100. A plurality of gripper pads 101 are provided at certain predetermined intervals along the axial directions of the impression cylinder 100 in each of the gap portions 100*a* of the impression cylinder 100. The gripper pads 101 are provided at an end located at an upper stream side (at a first side in the circumferential direction, i.e., at the right side in FIG. 3 and at the downside in FIG. 4) in the rotational direction of the impression cylinder 100. The gripper pads 101 are provided as being drawn inwards to the axis of the impression cylinder 100 from the outer peripheral surface of the impression cylinder 100.

A gripper shaft 102 is provided at the gap portion 100*a* of the impression cylinder 100, while the gripper shaft 102 is arranged with its longer side oriented along the axial directions of the impression cylinder 100. The gripper shaft 102 is supported as being capable of rotating relatively to the impression cylinder 100. A plurality of grippers 103 are provided to the gripper shaft 102 at certain predetermined intervals along the axial directions of the impression cylinder 100 in each of the gap portions 100*a* of the impression cylinder 100, while the front end side of each gripper 103 is placed on the corresponding one of the gripper pads 101.

In other words, the distance between the axis and each gripper pad 101 in the impression cylinder 100 is made to be the same as that in each one of the impression cylinders 21*a* to 21*d* and the transfer cylinders 26*a* to 26*d*. The distance in the impression cylinder 100 is also made to be the same as that in each one of a transfer cylinder 26*e*, a transport cylinder 28, and a delivery cylinder 31, all of which are described-later. At the same time, the distance between the axis and the outer peripheral surface in the impression cylinder 100 is made to be larger than that in each of the rest of these cylinders mentioned above. As a result, while the gripper pads 100 and grippers 103 are prevented from projecting out from the outer peripheral surface of the impression cylinder 100, the impression cylinder 100 can transfer the paper sheet 1 from the transfer cylinder 26*d* to the transfer cylinder 26*e*. In addition, the impression cylinder 100 can hold the paper sheet 1 on the outer peripheral surface thereof by holding, with the gripper 103 and the like, the front end side of the paper sheet 1.

Note that, in FIG. 4, reference numeral 104 is a cam follower to turn the gripper shaft 102. In this embodiment as has been described thus far, the gripper pads 101, the gripper shaft 102, the grippers 103 and the like constitute sheet-holding means.

Figure 5:
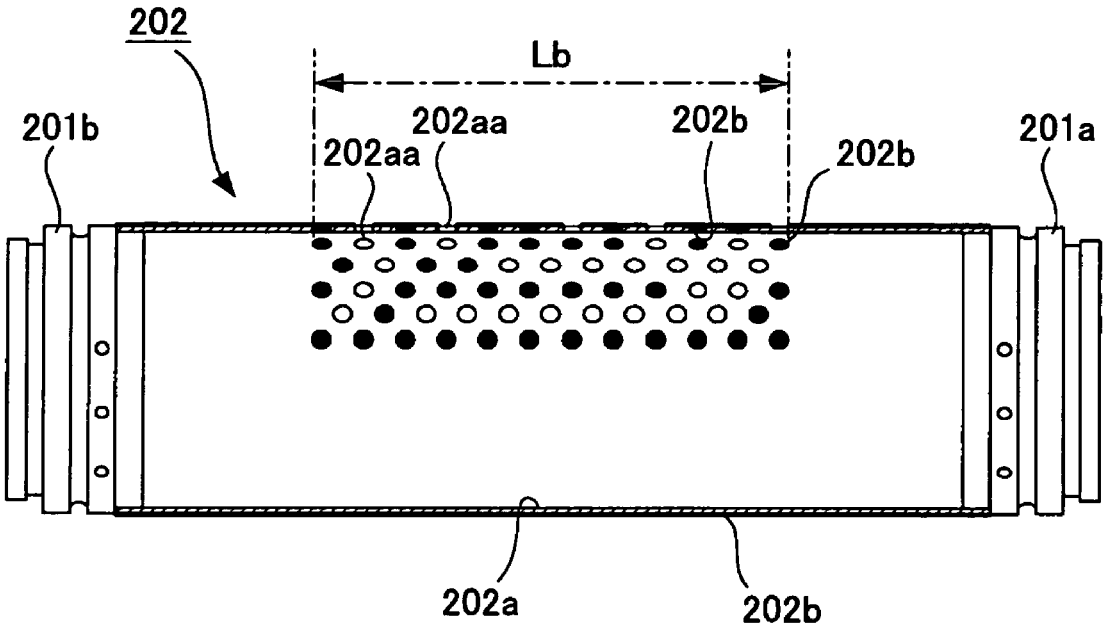
FIG. 5 shows an axial sectional view of a main part of a rotary screen apparatus of FIG. 2.

In addition, as shown in FIG. 1 to FIG. 3, a rotary screen apparatus 200 faces and is in contact with the impression cylinder 100 of the screen printing unit 20*e* at a position further downstream than the transfer cylinder 26*d*, in the rotational direction of the impression cylinder 100. The rotary screen apparatus 200 has the following structure as shown in FIG. 2, FIG. 3 and FIG. 5. The rotary screen apparatus 200 includes cylindrical flanges 201*a* and 201*b*, a screen 202, which is a plate, a reservoir portion 203 and a squeegee 204. The cylindrical flanges 201*a* and 201*b* are supporting members and are rotatably supported. The cylindrical flanges 201*a* and 201*b* support the two end portions of the screen 202. The screen 202 thus supported faces and is brought into contact with the impression cylinder 100. The screen 202 includes a base material 202*a* and a photosensitive material 202*b*. The base material 202*a* is a nickel cylindrical member, and multiple small holes 202*aa* are formed only in a certain area of the circumferential surface of the base material 202*a*. The area is delimited by positions corresponding to the ends of the paper sheet 1 conveyed by the impression cylinder 100. The above-mentioned ends of the paper sheet 1 are: the end located on the downstream-side in the direction in which the paper sheet 1 is conveyed (the leading end); the end located on the upstream-side in the direction in which the paper sheet 1 is conveyed (the tail end); an end located on a first side of the paper sheet 1 in a orthogonal direction to the direction in which the paper sheet 1 is conveyed (a first-side end in the width direction of the paper sheet 1); and an end located on a second side of the paper sheet 1 in a orthogonal direction to the direction in which the paper sheet 1 is conveyed (a second-side end in the width direction of the paper sheet 1). In other words, the area on the circumferential surface of the base material 202*a* with holes is located between the positions corresponding to the leading end and the tail end, and at the same time, between the first-side end and the second-side end. Specifically, while, in the paper sheet 1, an area to which the liquid is supplied is defined as an effective printing surface 1*a* (having an area of La×Lb), the area in which the small holes 202*aa* are formed corresponds to the effective printing surface 1*a*. Accordingly, the area with small holes 202*aa* also has an area of La×Lb. No small holes 202*aa* are formed outside of the area thus delimited. To put it other way, the area without any small holes 202*aa* is defined as follows. The area is located between the position corresponding to the end located on the downstream side, in the conveying direction, of the paper sheet 1 (corresponding to the above-mentioned leading end) and the position corresponding to the end located on the upstream side, in the conveying direction, of the paper sheet 1 (corresponding to the above-mentioned tail end). However, the area is located at the further downstream side, in the above-mentioned conveying direction, than the position corresponding to the leading end and, at the same time, located at the further upstream side, in the conveying direction, than the position corresponding to the tail end. In addition, the area without any small holes 202*aa* includes the area located at the outer side of each of the positions corresponding respectively to the ends, in the orthogonal direction to the conveying direction (in the width direction), of the paper sheet 1. The photosensitive material 202*b*, which is a coating material, provided on entirely the outer circumferential surface of the screen 202 both in the circumferential direction and in the axial direction of the screen 202. The photosensitive material 202*b* fills up some part of the small holes 202*aa*, whereas only those small holes 202*aa* that are located at positions corresponding to the target pattern are left unfilled. The ink reservoir portion 203 located at the inner side of the screen 202 stores a liquid, or, to be more specific, a special ink 2. The squeegee 204 is a liquid supply member, and is also provided at the inner side of the screen 202 and is in contact with the inner circumferential surface of the screen 202. The squeegee 204 squeezes-out and supplies the special ink 2 in the ink reservoir portion 203 to the outer side of the screen 202 through the small holes 202*aa* formed in the screen 202.

As shown in FIG. 1, the impression cylinder 100 of the screen printing unit 20*e* faces and is brought into contact with the transfer cylinder 26*e* at a position further downstream in the rotational direction of the impression cylinder 100 than the rotary screen apparatus 200. An example of such a transfer cylinder 26*e* is a skeleton cylinder (solid cylinder) with a guiding unit 27*b* which is provided therebelow, and which blows out air to guide the transfer of the paper sheet 1, as is described in Japanese Patent Publication No. 2004-099314A. The transfer cylinder 26*e* faces and is brought into contact with the transport cylinder 28 of a drying unit 20*f* at a position further downstream in the rotational direction of the transfer cylinder 26*e* than the impression cylinder 100. A drying lamp 29, which irradiates ultraviolet rays (UV), is provided at a position further downstream in the rotational direction of the transport cylinder 28 than the transfer cylinder 26*e*.

The transport cylinder 28 of the drying unit 20*f* faces and is brought into contact with the delivery cylinder 31 of the delivery unit 30 at a position further downstream in the rotational direction of the transport cylinder 28 than the drying lamp 29. A sprocket 32 is provided coaxially to, and rotatably together with, the delivery cylinder 31. A delivery tray 35 is provided to the delivery unit 30. A sprocket 33 is provided over the delivery tray 35. A delivery chain 34, to which a plurality of unillustrated delivery grippers at certain predetermined intervals are attached, is looped between the sprockets 32 and 33.

Here, explanations will be given of a manufacturing apparatus for manufacturing the screen 202 with the structure described above.

Figure 6:
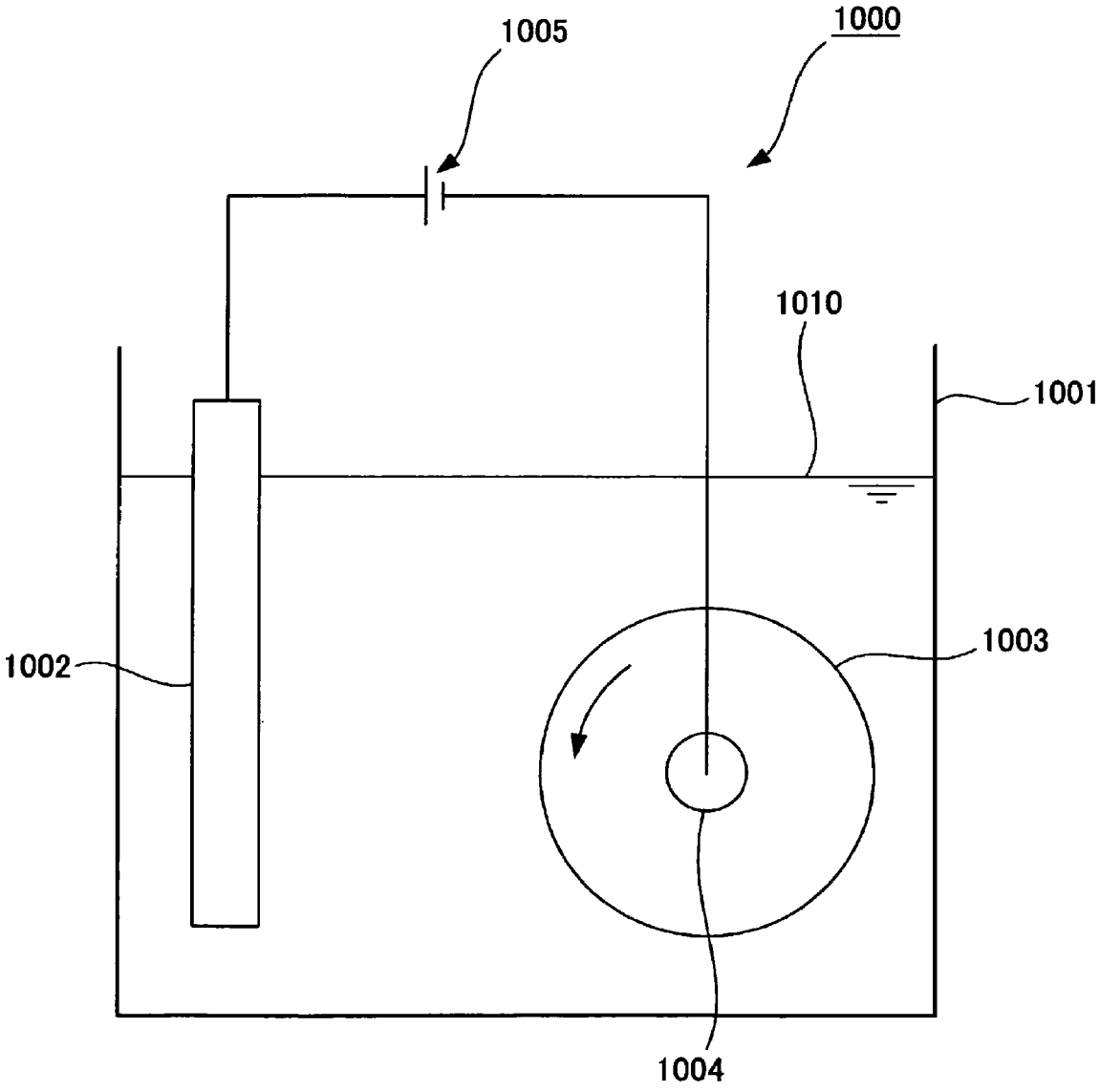
FIG. 6 shows a schematic configuration view of an apparatus for manufacturing a screen of FIG. 2.

As shown in FIG. 6, a screen manufacturing apparatus 1000 includes an electroforming bath 1001, an electrode plate 1002, a mother die 1003, a driving apparatus 1004 and a DC power supply apparatus 1005. An electroforming solution 1010, which is an aqueous solution containing nickel ions, is stored in the electroforming bath 1001. The electrode plate 1002 is made of nickel, and is placed inside the electroforming bath 1001. The mother die 1003 is made of copper-plated iron or copper, and is either cylindrical or columnar. In other words, the mother die 1003 has a cylindrical or columnar circumferential surface made of copper. Multiple minute dimples 1003*a* are formed only in a certain area of the outer peripheral surface of the mother die 1003 (see FIG. 7A). The area with dimples 1003*a* corresponds to the area of the effective printing surface 1*a* (having an area of La×Lb), and thus has an area of La×Lb. The drive apparatus 1004 is disposed inside the electroforming bath 1001, and is capable of ascending and descending. The drive apparatus 1004 detachably supports and drives to rotate the mother die 1003. The drive apparatus 1004 also allows the electric currents to flow to the mother die 1003. The DC power supply apparatus 1005 has its cathode connected to the electrode plate 1002 and its anode connected to the drive apparatus 1004.

Subsequently, explanations of a manufacturing method for manufacturing the screen 202 using the screen manufacturing apparatus 1000 will be given.

Figure 7A:
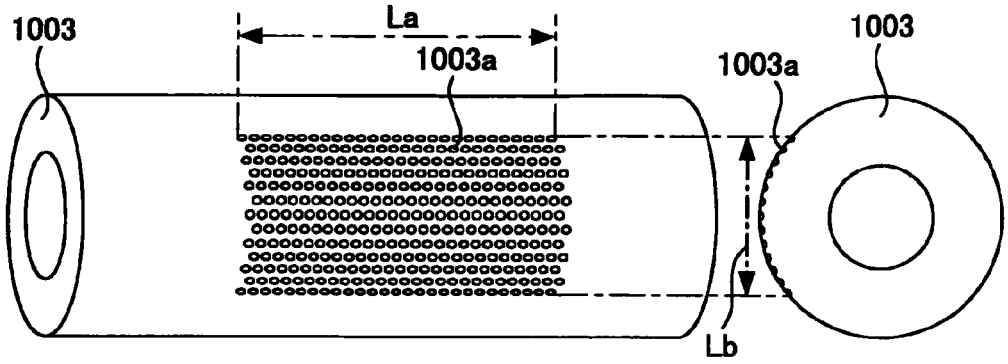
FIGS. 7A to 7C and FIGS. 8D to 8F show explanatory drawing showing processes in a method of manufacturing the screen of FIG. 2.
Figure 7B:
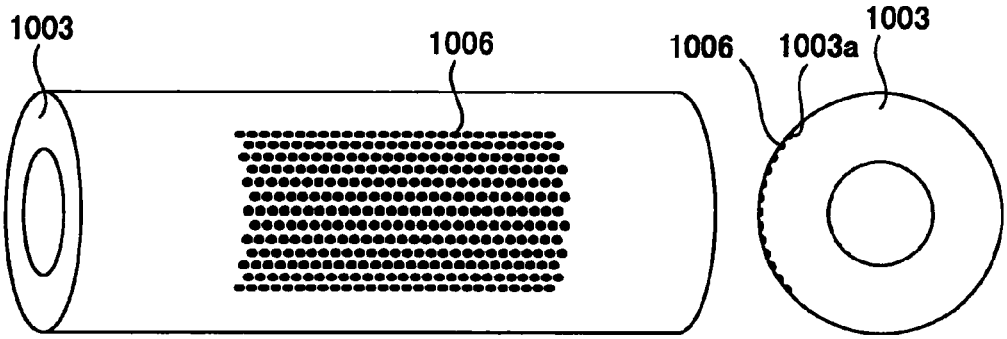
Figure 7C:
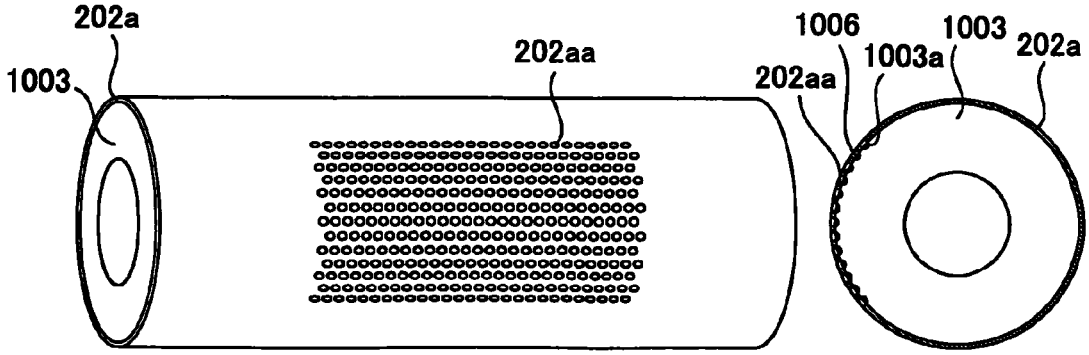

Firstly, to eliminate any irregularity of the outer peripheral surface of the mother die 1003, the dimples 1003*a* are filled up with a masking material for holes 1006 such as paraffin, resin and tape (the process described thus far is referred to as a masking step; see FIG. 7B). The mother die 1003 is attached to the drive apparatus 1004 of the screen manufacturing apparatus 1000, and then is immersed into the electroforming solution 1010 stored in the electroforming bath 1001.

Secondly, the DC power supply apparatus 1005 is activated to make the electric current flow between the electrode plate 1002 and the mother die 1003 and at the same time the drive apparatus 1004 drives to rotate the mother die 1003. Then, the nickel ions in the electroforming solution 1010 are electrodeposited on the outer circumferential surface of the mother die 1003 (thereby the surface is plated) while avoiding the portions corresponding to the masking material 1006 on the outer circumferential surface of the mother die 1003. In this way, multiple small holes are formed only on the area (La×Lb) corresponding to the effective printing surface 1*a* (La×Lb), and the cylindrical base material made of nickel (mother material) 202*a* is formed (electroformed) on the outer circumferential surface of the mother die 1003 (the process as described thus far is referred to as an electroforming step; see FIG. 7C).

Thirdly, once the base material 202*a* is formed on the mother die 1003 in this way, the DC power supply apparatus 1005 is turned off to stop the flow of the electric current between the electrode plate 1002 and the mother die 1003. At the same time, the drive apparatus 1004 stops driving to rotate the mother die 1003, and the mother die 1003 is pulled out of the electroforming solution 1010 stored in the electroforming bath 1001. Then, the mother die 1003 is detached from the driving apparatus 104, and, after that, the base material 202*a* is detached from the mother die 1003 (the process as described thus far is referred to as a mother material fabricating step; see FIG. 8D).

Figure 8D:
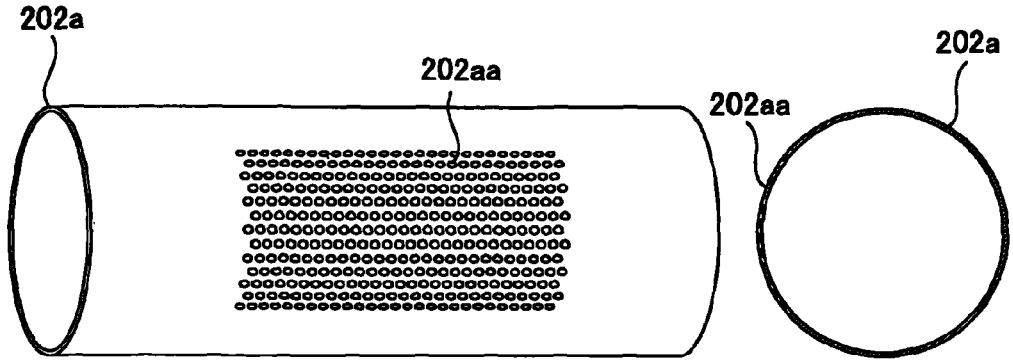
Figure 8E:
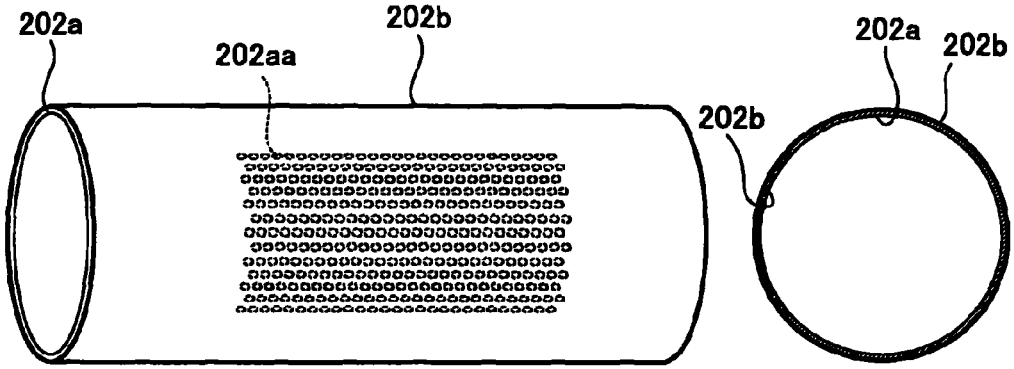
Figure 8F:
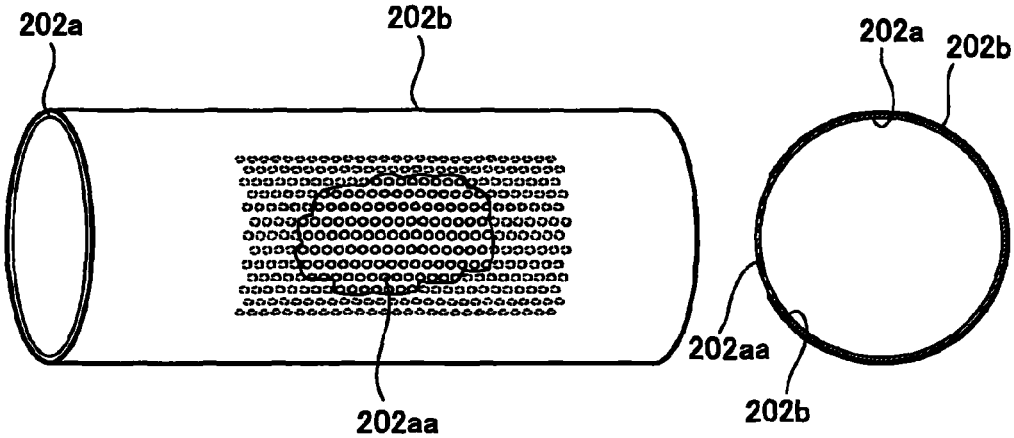

Fourthly, the photosensitive material 202*b*, which is a coating material used for plate-making, is provided on entirely the outer circumferential surface of the base material 202*a* both in the circumferential direction and in the axial direction of the screen 202 so that all the small holes 202*aa* of the base material 202*a* can be filled up with the photosensitive material 202*b* (the process as described thus far is referred to as a coating step; see FIG. 8E). Then, the outer circumferential surface of the base material 202*a* located in the above-mentioned area (La×Lb) in which the small holes 202*aa* are formed is exposed to light with the target pattern so that the photosensitive material 202*b* located at positions corresponding to the pattern is removed. Thus produced cylindrical screen 202 has following features. The outer circumferential surface of the cylindrical screen 202 is entirely covered with the photosensitive material 202*b* both in the circumferential direction and in the axial direction of the screen 202. The small holes 202*aa* are formed only in a certain part of the circumferential surface, to be more specific, formed only in the area (La×Lb) that corresponds to the effective printing surface 1*a* of the paper sheet 1. Of these small holes 202*aa*, those small holes 202*aa* that are located at positions corresponding to the target pattern are removed while those small holes 202*aa* that are located at other positions are left filled up with the photosensitive material 202*b* (the process as described thus far is referred to as a removal step; see FIG. 8F).

Subsequently, explanations will be given of the advantages of the printing press of this embodiment, which has a configuration described above.

The paper sheet 1 fed, one by one, from the feeder tray 11 of the feeder 10 to the feeder board 12 is transferred, with use of the swing arm shaft pregripper 13, to the impression cylinder 21*a* of the first offset printing unit 20*a* of the printing unit 20. Meanwhile, ink and dampening water are supplied, from the ink supplying unit 24*a* and the damping unit 25*a* of the first offset printing unit 20*a*, respectively, to the plate cylinder 23*a*, and then from the plate cylinder 23*a* to the blanket cylinder 22*a*. Then, the paper sheet 1 receives the ink transferred from the blanket cylinder 22*a*, and thus the resultant paper sheet 1 is subjected to the printing with a first color. Then, the resultant paper sheet 1 is transferred to the impression cylinder 21*b* of the second offset printing unit 20*b* via transfer cylinder 26*a*. As in the case of the first offset printing unit 20*a*, the paper sheet 1 is subjected to the printing with a second color in the second offset printing unit 20*b*. Then, similarly, the paper sheet 1 is subjected to the printing with a third color and to that with a fourth color in the third and the fourth offset printing units 20*c* and 20*d*, respectively. After that, via the transfer cylinder 26*d*, the paper sheet 1 is transferred to the gripper pads 101 and the grippers 103 of the impression cylinder 100 of the screen printing unit 20*e*.

In the rotary screen apparatus 200 of the screen printing unit 20*e*, the screen 202 rotates with the impression cylinder. The paper sheet 1 with the effective printing surface 1*a* is held on the outer peripheral surface of the impression cylinder 100. Squeegee 204 squeezes out the special ink 2 in the ink reservoir portion 203. The special ink 2 is only squeezed out from the small holes 202*aa* which the photosensitive material 202*b* is removed corresponding to the pattern. In this way, the thickly embossed printing on the effective printing surface 1*a* of the paper sheet 1 is carried out with the special ink 2.

The paper sheet 1 with the printing of the special ink 2 thickly embossed thereon, then, is transferred from the impression cylinder 100, via the transfer cylinder 26*e*, to the transport cylinder 28 of the drying unit 20*f*. After the special ink 2 printed on the paper sheet 1 is dried by the UV rays emitted from the drying lamp 29, the paper sheet 1 is transferred to the delivery cylinder 31 of the delivery unit 30. The paper sheet 1 is conveyed by the travel of the delivery chain 34 with use of the delivery gripper, and then is discharged to the delivery tray 35.

It is noted that the screen 202 of the rotary screen apparatus 200 has the small holes 202*aa* in only a part of its circumferential surface, to be more specific, only in the area (La×Lb) that corresponds to the area of the effective printing surface 1*a* (La×Lb) of the paper sheet 1. To put it differently, no small holes 202*aa* are formed in the part of the circumferential surface not facing the paper sheet 1. Accordingly, sufficient strength is given the part not facing the paper sheet 1, that is, the part which is in direct contact with the outer circumferential surface of the impression cylinder 100 and the part that faces the gap portion 100*a* of the impression cylinder 100. As a consequence, the strengthen part of the screen 202 becomes strong enough to tolerate the force with which the squeegee 204 pulls the screen 202 radially outwards.

Accordingly, the damage to the screen 202 is reduced significantly when the screen 202 faces the gap portion 100*a* of the impression cylinder 100, or when the screen 202 transfers from the top of the surface of the paper sheet 1 to the top of the surface of the impression cylinder 100.

For this reason, the screen 202 according to this embodiment suffers from much less damage than otherwise at the time of screen printing. As a result, the screen 202 can have a longer lifetime and can be reused more times than its counterpart in a conventional-type apparatus.

In addition, the photosensitive material 202*b* is provided on entirely the outer circumferential surface of the screen 202 both in the circumferential direction and in the axial direction of the screen 202. In other words, the screen 202 has outer circumferential surface covered with the resin coating in a portion that is to be brought into direct contact with the outer circumferential surface of the impression cylinder 100 and in a portion that is to face the gap portion 100*a* of the impression cylinder 100. Since the resin coating exists, the damage, which is likely to be done when the screen 202 is brought into contact with the edge located between the outer circumferential surface of the impression cylinder 100 and the gap portion 100*a*, can be effectively avoided. As a result, the screen 202 has an even longer lifetime.

Other Embodiments

As explained above, the mother die 1003 used in the main embodiment has minute dimples 1003*a* filled up with the masking material for holes 1006. The minute dimples 1003*a* are formed in the outer circumferential surface only in a certain area (La×Lb) that corresponds to the area (La×Lb) of the effective printing face 1*a* of the paper sheet 1. The screen 202 including the base material 202*a* in the main embodiment, is made by using the mother die 1003 with such dimples 1003*a*, the multiple small holes 202*aa* being formed in the outer circumferential surface only in a certain area (La×Lb) that corresponds to the area (La×Lb) of the effective printing face 1*a* of the paper sheet 1.

In an alternative embodiment, however, a screen can also be manufactured in the following way. Firstly, a base material without any small holes is manufactured by, for example, electroforming using a cylindrical or a columnar mother die with no dimples or the like formed in the circumferential surface. Then, holes are formed in the base material by such methods as the laser machining, the electric spark machining, and the drilling so that multiple small holes can be formed on the outer circumferential surface of the base material only in a certain area (La×Lb) that corresponds to the area (La×Lb) of the effective printing face 1*a* of the paper sheet 1.

The base material 202*a* of the screen 202 manufactured in the main embodiment is cylindrical in shape because the base material 202*a* is manufactured by electroforming using the mother die 1003 that has either a cylindrical or a columnar shape. In an alternative embodiment, however, a plate-shape base material can be manufactured by electroforming using a plate-shape mother die, for example. A cylindrical screen can be manufactured by curling the plate-shape base material thus manufactured and then by bonding the two ends of the plate-shape base material together.

However, as in the above-described embodiments, the manufacturing of the cylindrical base material 202*a* of the screen 202 is easier by electroforming using the mother die 1003 that has either a cylindrical or a columnar shape than by the above-described method using a plate-shape mother die. Accordingly, the use of the cylindrical or columnar mother die 1003 is greatly preferable.

In the main embodiment, the nickel base material 202*a* of the screen 202 used in the above-described embodiments is manufactured by performing electroforming in the electroforming solution 1010 which is an aqueous solution containing nickel ions. In an alternative embodiment, however, a base material of the screen may be made of a metal, such as copper, and an alloy of cobalt and nickel, and may be manufactured by electroforming performed in an electroforming solution of an aqueous solution containing such metal ions as those of copper, and those of both cobalt and nickel.

In the main embodiment, when the special ink 2 stored in the ink reservoir portion 203 is supplied to the outer side of the screen 202, the blade-shape squeegee 204 is used to push the special ink 2 out through the small holes 202*aa* perforated in the screen 202. In an alternative embodiment, however, when the special ink 2 stored in the ink reservoir portion 203 is supplied, a rotatable liquid supply member, such as a roller, which is disposed at the inner side of the screen 202 so as to be in contact with the inner circumferential surface of the screen 202, can be used to push the special ink 2 out.

In the main embodiment, as explained above, the gripper pads 101, the gripper shaft 102, the grippers 103, and the like can constitute sheet-holding means. In an alternative embodiment, a suction holding means can constitute sheet-holding means, as described in Japanese Patent Publication No. 2001-225445A. The suction holding means includes a suction holder, a suction means and a switching means. The suction holder is provided to the gap portion formed in the outer circumferential surface of the impression cylinder, and a suction mouth is opened in the surface of the suction holder. The suction means is connected to the suction holder. The suction holding means is provided between the suction holder and the suction means. The switching means is provided between the suction holding means and the suction means and connects the two. When the suction holder receives a sheet, the switching means communicatively connects the suction holding means and the suction means. On the other hand, when the suction holder hand over a sheet, the switching means cuts off the communication between the suction holder and the suction means.

In addition, as described, for example, in the Japanese Patent Publication No. 2005-254640A, a cover member (gap guard) can be provided to the gap portion 100*a* of the impression cylinder 100 so as to cover only a part of the gap portion 100*a*. Here, the grippers 103 can protrude from the cover member at the time of holding the paper sheet 1 or of releasing the paper sheet 1.

Figure 9:
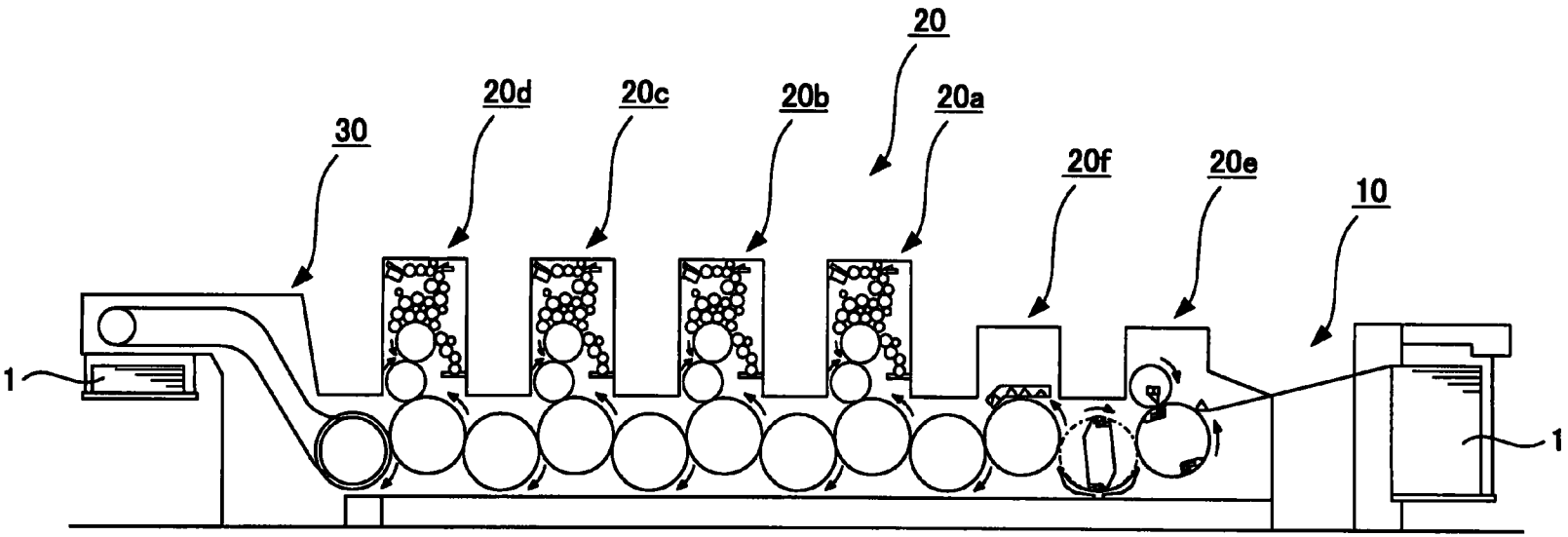
FIG. 9 shows an overall schematic configuration view of a printing press in which a liquid supply apparatus of the present invention is applied to a screen printing unit according to another embodiment.
Figure 10:
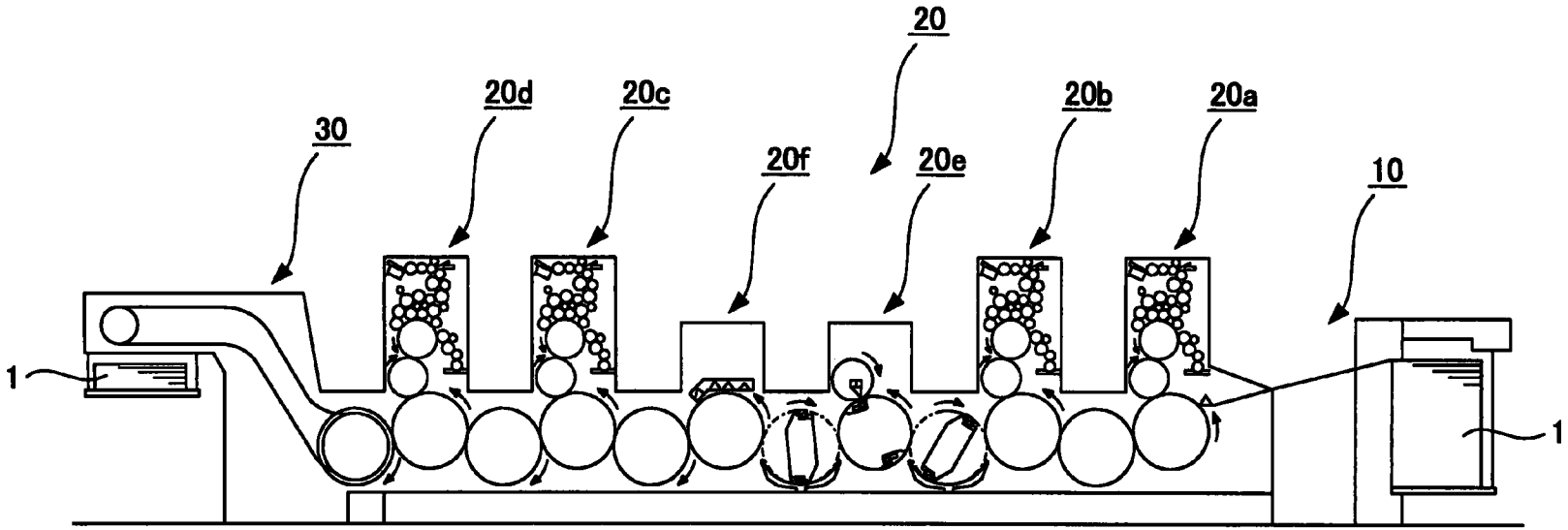
FIG. 10 shows an overall schematic configuration view of a printing press in which a liquid supply apparatus of the present invention is applied to a screen printing unit according to another embodiment.

In addition, in the main embodiment, as explained above, the screen printing unit 20*e* and the drying unit 20*f* can be disposed in places at the downstream side of the first to the fourth offset printing units 20*a* to 20*d*. In an alternative embodiment, the screen printing unit 20*e* and the drying unit 20*f* can be disposed in places at the upstream side of the first to the fourth offset printing units 20*a* to 20*d* as shown in FIG. 9. Still alternatively, the screen printing unit 20*e* and the drying unit 20*f* can be disposed in places between the second offset printing unit 20*b* and the third offset printing unit 20*c*, as shown in FIG. 10.

Figure 11:
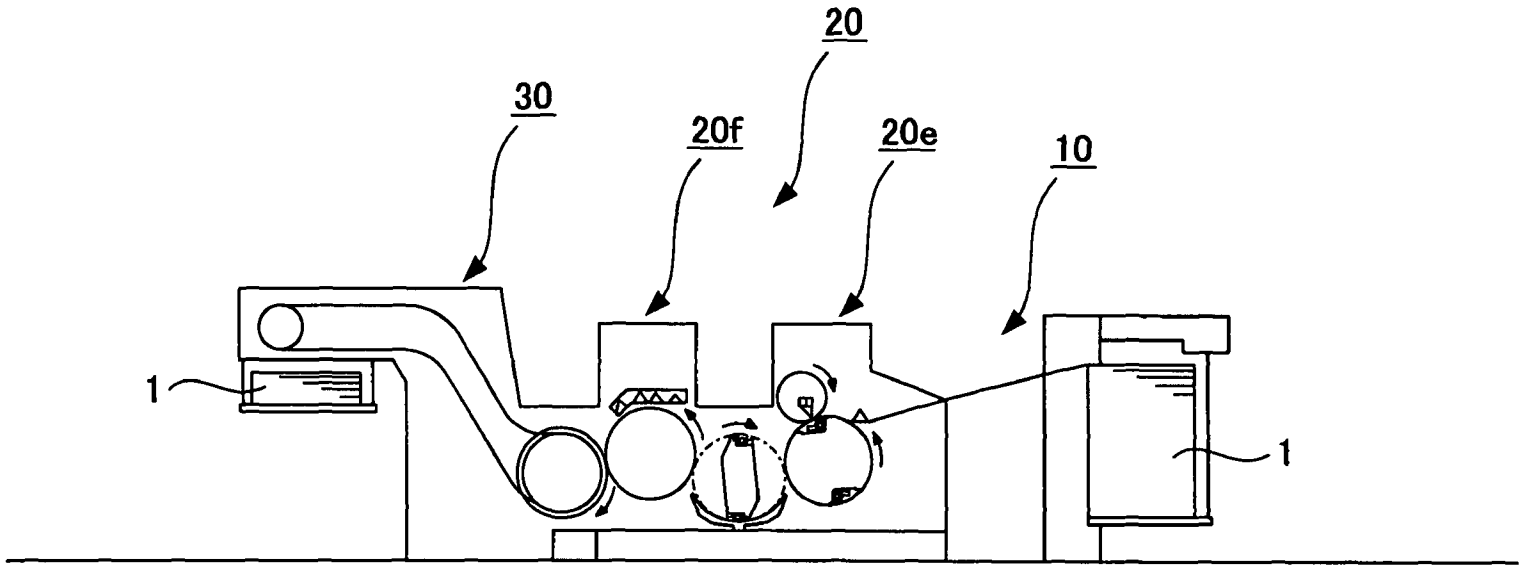
FIG. 11 shows an overall schematic configuration view of a printing press in which a liquid supply apparatus of the present invention is applied to a screen printing unit according to another embodiment.

In addition, in the main embodiment, as explained above, the liquid supply apparatus of the present invention can be applied to the printing press with the offset printing units 20*a* to 20*d* and the screen printing unit 20*e* being combined together. In an alternative embodiment, the liquid supply apparatus can be applied, for example, to a screen printing press that does not have any offset printing unit. In other words, the liquid supply apparatus can be applied to a screen printing press that includes the feeder 10, the screen printing unit 20*e*, the drying unit 20*f* and the delivery unit 30, as shown in FIG. 11. In addition, the liquid supply apparatus can be used by being combined with a processing unit other than a printing unit. For example, the liquid supply apparatus can be combined with a rotary punching machine.

In the above-described embodiments, the liquid supply apparatus of the present invention can be applied to the screen printing unit 20*e*. The screen printing unit 20*e* performs thickly embossed printing of a target pattern on an effective printing surface 1*a* of a paper sheet 1 with the special ink 2. The special ink 2 is stored inside the screen 202 of the rotary screen apparatus 200, and is squeezed out, by the squeegee 204, through the small holes 202*aa* which the photosensitive material 202*b* is removed corresponding to the pattern. However, the present invention is not limited to such embodiments. For example, varnish may be stored inside a rotary screen apparatus and applied to the sheet. In this case, varnish is squeezed out, by a squeegee, from holes (all of the holes), from which a coating is removed, holes being positioned in area according to the target pattern (whole surface of the sheet). Thus, the liquid supply apparatus may be used as coating unit (coating apparatus) for coating the whole surface of the sheet. As long as a liquid is supplied by liquid supplying member, though holes formed in a plate for rotary screen apparatus, to the sheet member held by the impression cylinder, the liquid supply apparatus of the present invention can be applied, in a similar way to the case of the above-described embodiments.

In the liquid supply apparatus according to the present invention, the holes are formed only in an area of the plate in the circumferential direction of thereof. The area extends from a position corresponding to the downstream-side end of the sheet in the direction in which the sheet is conveyed to a position corresponding to the upstream end of the sheet in the direction in which the sheet is conveyed, so that the area covers the area of the sheet as a whole. To put it other way, no holes are formed in the part where the plate does not face the sheet. Accordingly, sufficient strength is given to the part of the circumferential surface of the plate not facing the sheet. The part of the plate becomes strong enough to tolerate the force with which the squeegee pulls the plate radially outwards.

The use of the liquid supply apparatus according to the present invention significantly reduces damage done to the plate even when the plate transfers from the top surface of sheet to the top surface of the impression cylinder. Thereby, the plate has a longer service life. In addition, the use of the method of manufacturing the plate for the liquid supply apparatus according to the present invention helps to achieve a low-cost and easy manufacturing of the plate. Accordingly, the liquid supply apparatus and the method of manufacturing the plate for the liquid supply apparatus according to the present invention are very useful when they are used in the printing industry and the like.

The invention thus described, it will be obvious that the same may be varied in many ways. Such variations are not to be regarded as a departure from the spirit and scope of the invention, and all such modifications as would be obvious to one skilled in the art are intended to be included within the scope of the claims.

What is claimed is:

1. A liquid supply apparatus comprising a rotary screen apparatus that comprises:

a cylindrical plate rotatably supported so as to be brought into contact with a rotatable impression cylinder, the cylindrical plate defining multiple openings, located at positions corresponding to a pattern, therein, some of the multiple openings being filled with a coating material to prevent a liquid stored inside the cylindrical plate from passing through the opening, and some of the multiple openings forming holes that allow the liquid to pass therethrough, such that the liquid is supplied to a sheet held on an outer circumferential surface of the impression cylinder, thus forming a shape corresponding to the pattern; and a liquid supply member placed inside the plate so as to be brought into contact with an inner circumferential surface of the plate, the liquid supply member supplying the liquid stored inside the plate to the outside of the plate through the holes, wherein the multiple openings are formed only in an area of the plate in a circumferential direction thereof, the area being located at an upstream side, in a direction in which the sheet is conveyed, of a first position and at a same time being located at a downstream side, in the direction in which the sheet is conveyed, of a second position, the first position corresponding to a first end of the sheet located on the downstream side in the direction in which the sheet is conveyed while the second position corresponding to a second end of the sheet located on the upstream side in the direction in which the sheet is conveyed, wherein the openings are formed in the plate at a portion covering an area of the sheet that is conveyed by the impression cylinder, and no openings are formed in the plate at a portion located outside of the area of the sheet that is conveyed by the impression cylinder.

2. The liquid supply apparatus according to claim 1, wherein the openings are formed only in an area of the plate in an axial direction thereof, the area being located between two positions, a first one of the two positions corresponding to the first end of the sheet located on a first side thereof in a direction orthogonal to the direction in which the sheet is conveyed, and a second one of the two positions corresponding to the second end of the sheet located on a second side thereof in a direction orthogonal to the direction in which the sheet is conveyed.

3. The liquid supply apparatus according to claim 1 further comprising:

a gap portion formed in the outer circumferential surface of the impression cylinder; and sheet holding means configured to hold the sheet and being installed in the gap portion, wherein the gap portion of the impression cylinder is brought into contact with a portion of the plate where no openings are formed.

4. A liquid supply apparatus comprising a rotary screen apparatus that comprises:

a cylindrical plate rotatably supported so as to be brought into contact with a rotatable impression cylinder, the cylindrical plate defining multiple openings, located at positions corresponding to a pattern, therein, some of the multiple openings being filled with a coating material to prevent a liquid stored inside the cylindrical plate from passing through the opening, and some of the multiple openings forming holes that allow the liquid to pass therethrough, such that the liquid is supplied to a sheet held on an outer circumferential surface of the impression cylinder, thus forming a shape corresponding to the pattern; and a liquid supply member placed inside the plate so as to be brought into contact with an inner circumferential surface of the plate, the liquid supply member supplying the liquid stored inside the plate to the outside of the plate through the holes, wherein the multiple openings are formed only in an area of the plate in a circumferential direction thereof, the area being located at an upstream side, in a direction in which the sheet is conveyed, of a first position and at a same time being located at a downstream side, in the direction in which the sheet is conveyed, of a second position, the first position corresponding to a first end of the sheet located on the downstream side in the direction in which the sheet is conveyed while the second position corresponding to a second end of the sheet located on the upstream side in the direction in which the sheet is conveyed, wherein no openings are formed in an area of the plate in the circumferential direction thereof, the area being located at the downstream side, in the direction in which the sheet is conveyed, of the first position corresponding to the first end of the sheet located on the downstream side in the direction in which the sheet is conveyed, and the area being located at the upstream side, in the direction in which the sheet is conveyed, of the second position corresponding to the second end of the sheet located on the upstream side in the direction in which the sheet is conveyed.

5. The liquid supply apparatus according to claim 4, wherein the coating material is formed in an area of the plate in the circumferential direction of the plate, the area being located at the downstream side, in the direction in which the sheet is conveyed, of the position corresponding to a downstream-side end of the sheet in the direction in which the sheet is conveyed, and the area being located at the upstream side, in the direction in which the sheet is conveyed, of the position corresponding to an upstream-side end of the sheet in the direction in which the sheet is conveyed.

* * * * *